US006120344A

United States Patent [19]

Brown

[11] Patent Number: 6,120,344

[45] Date of Patent: Sep. 19, 2000

[54] THREE-DIMENSIONAL FOLDED CARTON ACTION FIGURES

[76] Inventor: Jerry L. Brown, 683 N. Shore Dr., Forest Lake, Minn. 55025

[21] Appl. No.: 09/111,261

[22] Filed: Jul. 6, 1998

Related U.S. Application Data

[63] Continuation-in-part of application No. 08/644,046, May 9, 1996, Pat. No. 5,775,971.

[51] Int. Cl.[7] ..... A63H 3/08

[52] U.S. Cl. ..... 446/388; 446/97; 446/321; 446/376

[58] Field of Search ..... 446/97, 98, 99, 446/100, 321, 376, 384, 387, 388, 390

[56] References Cited

U.S. PATENT DOCUMENTS

| | | | |
|---|---|---|---|
| 554,410 | 2/1896 | Bailey | 446/387 |
| 628,239 | 7/1899 | Cohn | 446/387 X |
| 1,181,421 | 5/1916 | Apt | 446/87 |
| 1,211,232 | 1/1917 | Read | 446/99 |
| 1,509,604 | 9/1924 | Myers | 446/99 |
| 1,544,645 | 7/1925 | Johnson | 446/387 |
| 1,681,537 | 8/1928 | Hitchcock | 446/387 X |
| 2,203,128 | 6/1940 | Cairo | 446/387 |
| 2,365,098 | 2/1944 | Nudelman . | |
| 2,927,400 | 3/1960 | Bailey | 446/387 X |
| 3,914,897 | 10/1975 | Schoeman et al. | 446/387 X |
| 4,057,247 | 11/1977 | Morrison | 446/326 X |
| 4,279,419 | 7/1981 | Barnes et al. | 446/376 X |
| 4,798,317 | 1/1989 | Lonczak | 446/388 X |
| 4,869,701 | 9/1989 | Kawai et al. | 446/321 X |
| 4,995,846 | 2/1991 | Mariol | 446/376 |
| 5,386,656 | 2/1995 | Bergman . | |
| 5,458,521 | 10/1995 | Todd | 446/80 X |

FOREIGN PATENT DOCUMENTS

| | | | |
|---|---|---|---|
| 500814 | 3/1954 | Canada | 446/99 |
| 490489 | 2/1965 | Italy | 446/376 |
| 616601 | 1/1949 | United Kingdom | 446/376 |

*Primary Examiner*—John A. Ricci
*Attorney, Agent, or Firm*—Kinney & Lange, P.A.

[57] ABSTRACT

A three-dimensional action figure is formed from flat sheet material. The torso of the action figure is a folded carton formed of sheet material. The action figure includes jointed movable members which are pivotally attached to the torso by means of a novel joint. The joint allows the movable members to pivot 360° without disengagement from the torso, and with no additional support or connection such as a rivet. The characters may include animal, cartoon or human characters.

29 Claims, 18 Drawing Sheets

THREE-DIMENSIONAL FOLDED CARTON ACTION FIGURES

CROSS-REFERENCE TO RELATED APPLICATION(S)

This is a continuation-in-part of application Serial No. 08/644,046, filed May 9, 1996, now U.S. Pat. No. 5,775,971.

BACKGROUND OF THE INVENTION

The present invention relates to three-dimensional action figures. In particular, the present invention relates to three-dimensional human, animal or cartoon action characters formed from flat sheet material having torsos formed from folded cartons and jointed movable members which are assembled for oscillatory or pivotal movement with no eyelet, rivet or other added support for the movement.

There are many kinds of printed paper characters that are die-cut and tabbed, glued, or riveted together to form three-dimensional characters which represent real or imaginary figures. One group of printed toys includes flat character dolls that are die-cut and punched out of cardboard or similar material and inserted into a base member to allow the doll to stand upright. These dolls often have accessories such as clothes or weapons that are attached by tabs onto the core character. Another group of printed toys includes pop-up novelty cards, such as those shown in U.S. Pat. No. 5,386,656, which incorporate the character doll into an action background setting that gives the flat character an illusion of dimension.

While prior art paper dolls have been successful, they suffer from several deficiencies. Flat paper character dolls that are die-cut or punched out of cardboard or similar material and inserted into a base member to allow them to stand upright are generally presented in a fixed pose which may not be varied by the user, typically a child. The fixed pose limits the creative uses of the characters. The pop-up novelty cards, such as depicted in U.S. Pat. No. 5,386,656 are similarly provided in a fixed pose and are further typically permanently secured to a background action setting. In sum, the fixed poses of the prior art dolls limit the play potential for the characters and thus limit their attractiveness as useful toys. Additionally, the flat paper character dolls and even the pop-up novelty cards do not adequately or convincingly provide a sense of three-dimensionality, and are therefore not as attractive as toys. Finally, the two-dimensionality of the prior art figures also results in figures which are relatively flimsy and unsturdy. Because the figures are made out of thin sheet material which is typically flexible or bendable, the figures tend to bend and fold easily. The flexibility of the figures greatly reduces their durability and stability, and thus reduces their usefulness as toys.

Action figures which utilize movable joints are also known. For example, U.S. Pat. No. 2,365,098 discloses a cardboard action figure with a movable joint. However, the cardboard figures disclosed in U.S. Pat. No. 2,365,098 generally display only a two-dimensional quality, like the flat paper characters and pop-up novelty figures described above. In particular, the figures disclosed by U.S. Pat. No. 2,365,098 are assembled from sections of cut or punched out cardboard sections held together by friction and locking joints. In order to stand, the figures have a general inverted U or V-shape which gives them sufficient width to stand when placed on a table or other supporting surface. However, the figures are only viewable from the sides of the figures, and not the front or rear. If viewed from the front or rear, the figures appear only as two spaced-apart pieces of cardboard, and it is not possible to discern who or what the character is. Essentially, U.S. Pat. No. 2,365,098 replaces the base member of the flat paper character dolls with slightly spaced identical images of the figure to provide sufficient width to allow the figure to stand.

The joints used to allow movement in the figures of U.S. Pat. No. 2,365,098 utilize a slit in the stationary member and a radial slit in the movable member, such that the slit in the movable member interlocks with the slit in the stationary member and thereby allows the movable member to pivot relative to the stationary member. However, the joint of U.S. Pat. No. 2,365,098 only allows a limited range of movement for the movable member. If the relative rotation of the members exceeds a predetermined degree of rotation, the members become disengaged. Clearly, disengagement of the movable members (typically arms and legs) is not conducive to use of the character.

SUMMARY OF THE INVENTION

Given the problems and limitations of the prior art, a need exists for toy action characters formed of sheet material which provide an improved three-dimensional appearance regardless of the angle from which the character is viewed. There is also a need for a joint for use with such characters which allows movable members such as arms and legs to pivot freely (i.e., 360 degrees) without causing disengagement of the members. Further, a design which provides greater rigidity to the cardboard action characters is needed, to provide the characters with greater durability and stability.

The present invention provides three-dimensional toy characters formed of sheet material. The toy characters have three-dimensional "folded carton" torso members, formed of folded sheet material, and movable members formed of sheet material which are attached to the torso member by means of a novel joint.

The folded carton torso member provides a three-dimensional appearance regardless of the angle from which a character is viewed, and further allows the character to assume a wide variety of shapes.

The joint allows the movable members to pivot freely relative to the torso member, without causing disengagement of the members, and utilizes a crease in the movable member to urge the movable member into contact with the torso member. The joint utilizes a unique head portion having at least two tab members which engage a circular opening in the torso member. In addition, the construction of the characters of the present invention creates greater structural rigidity which gives the characters greater durability and stability.

DETAILED DESCRIPTION OF PREFERRED EMBODIMENTS

As shown in the Figures and described below, the present invention relates to three-dimensional human, animal or cartoon action characters having a folded carton torso formed from flat sheet material, as well as jointed movable members which are assembled without eyelets, rivets or other added support. The type of material used to form the characters may include any type of sheet material which may be cut and folded, including, but not limited to, paper, cardboard, plastic, and metal.

In one embodiment, the characters utilize sheet material folded to form a carton, thereby creating a three-dimensional body or torso member. The folded carton representing the body or torso of the character may be formed to any desired shape to simulate the body or torso of the character to be constructed. The folded carton torso may be retained in its folded condition by any means known in the art, including "slot and tab" connections, adhesive tape or glue. Other mechanical fastening means may also be used.

In three-dimensional characters representing persons or animals, the characterization or illusion of movement is provided in the form of jointed and pivotal legs, arms, jaws or other body members, making it possible to move the members to one position or another according to the pose or movement the character is intended to assume or illustrate. In each instance, the folded carton torso member of the three-dimensional character creates sufficient leg spread to allow the character to stand when placed on a table or other supporting surface.

Figure 10:
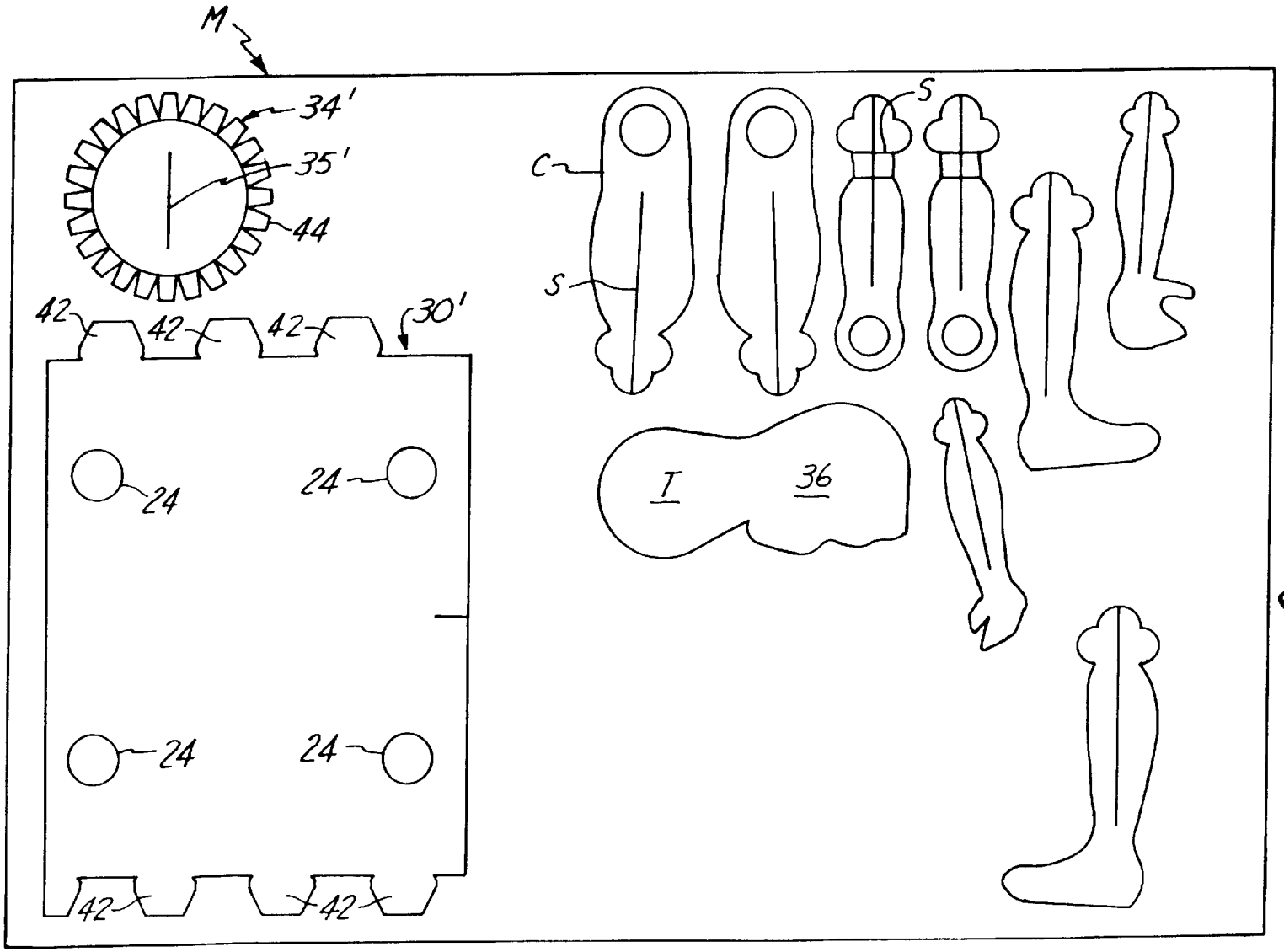
FIG. 10 is a plan view of unassembled and unfolded components of a human character having a cylindrically-shaped torso.
Figure 11:
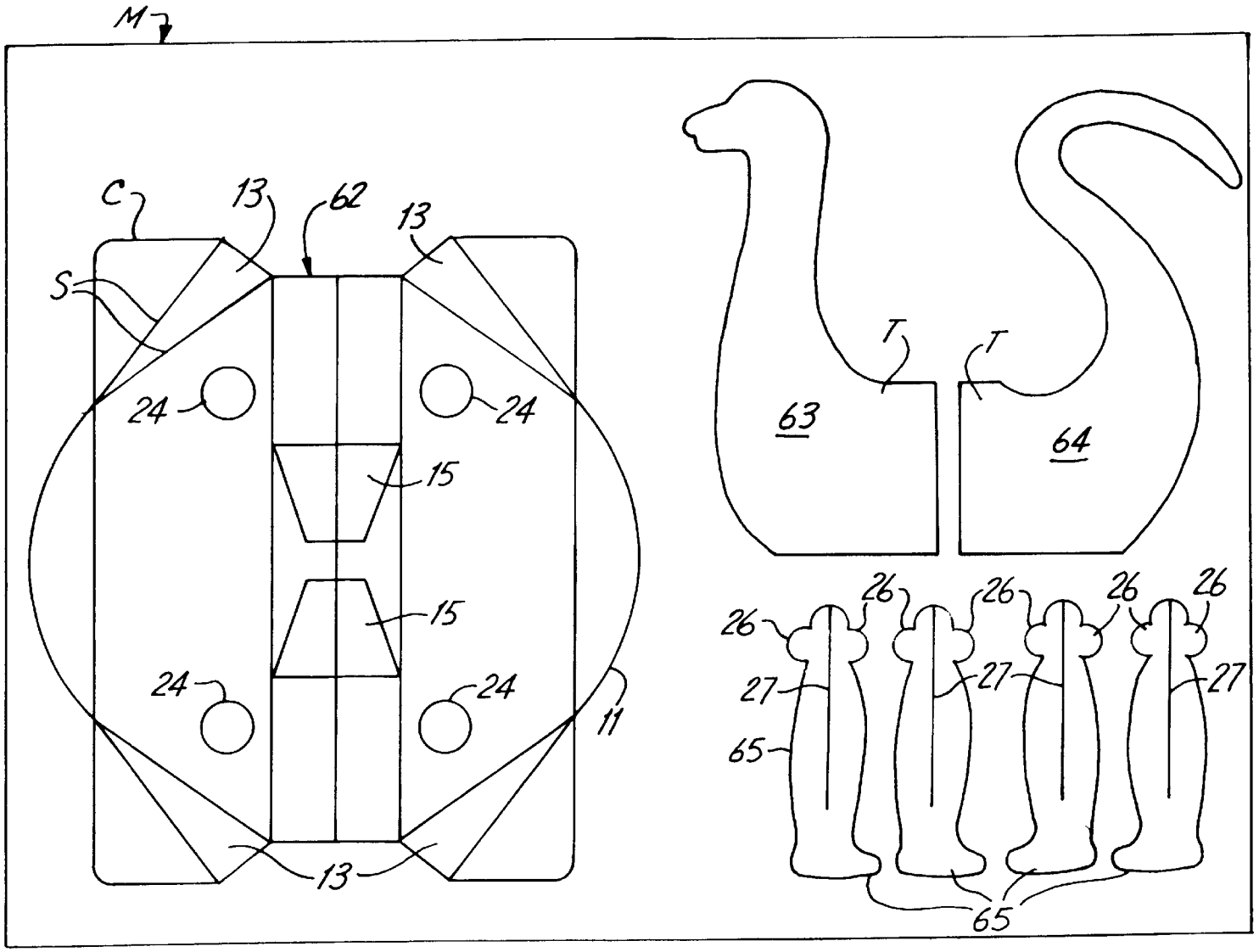
FIG. 11 is a plan view of unassembled and unfolded components of a dinosaur character.
Figure 12:
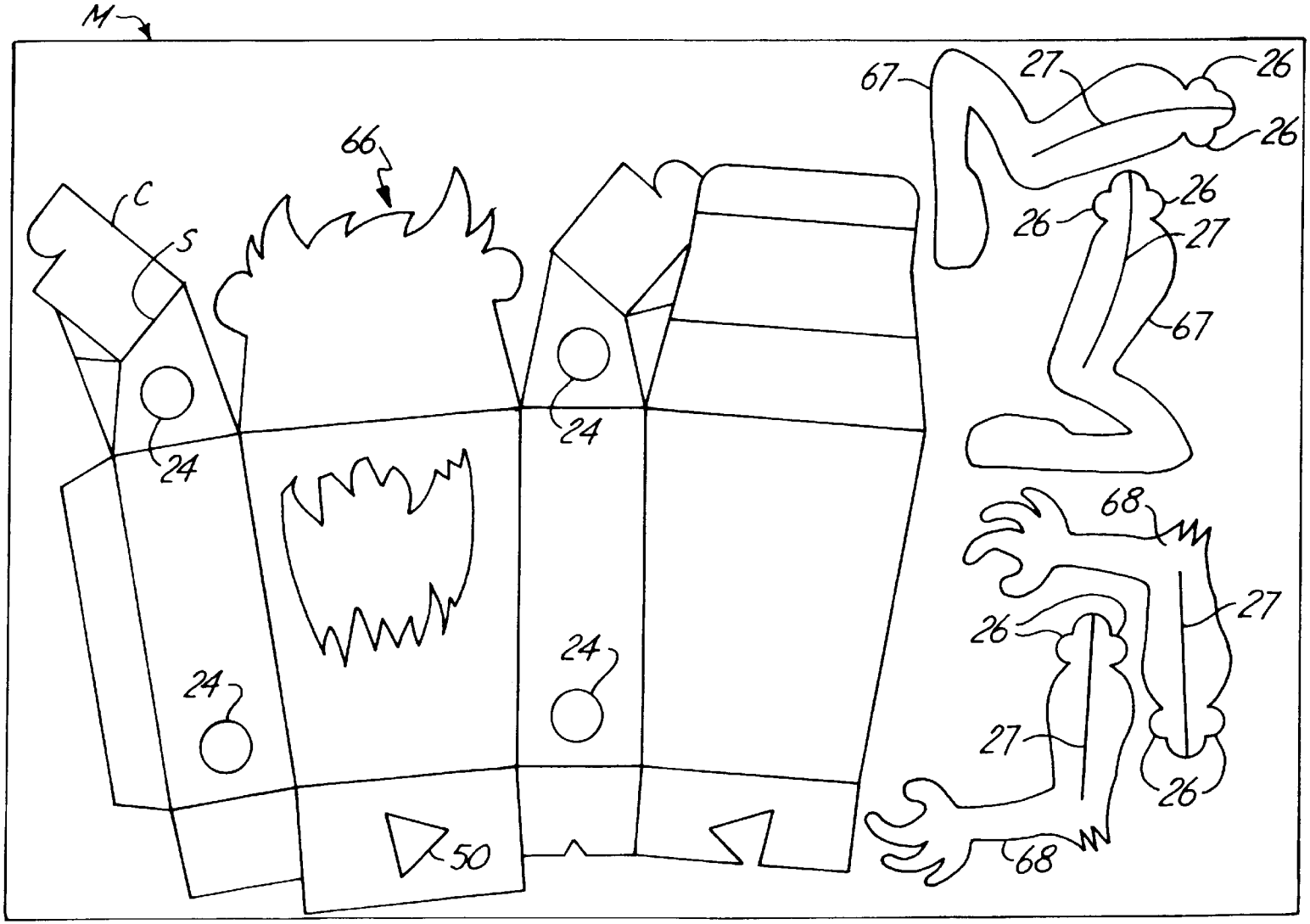
FIG. 12 is a plan view of unassembled and unfolded components of a cartoon character.
Figure 21:
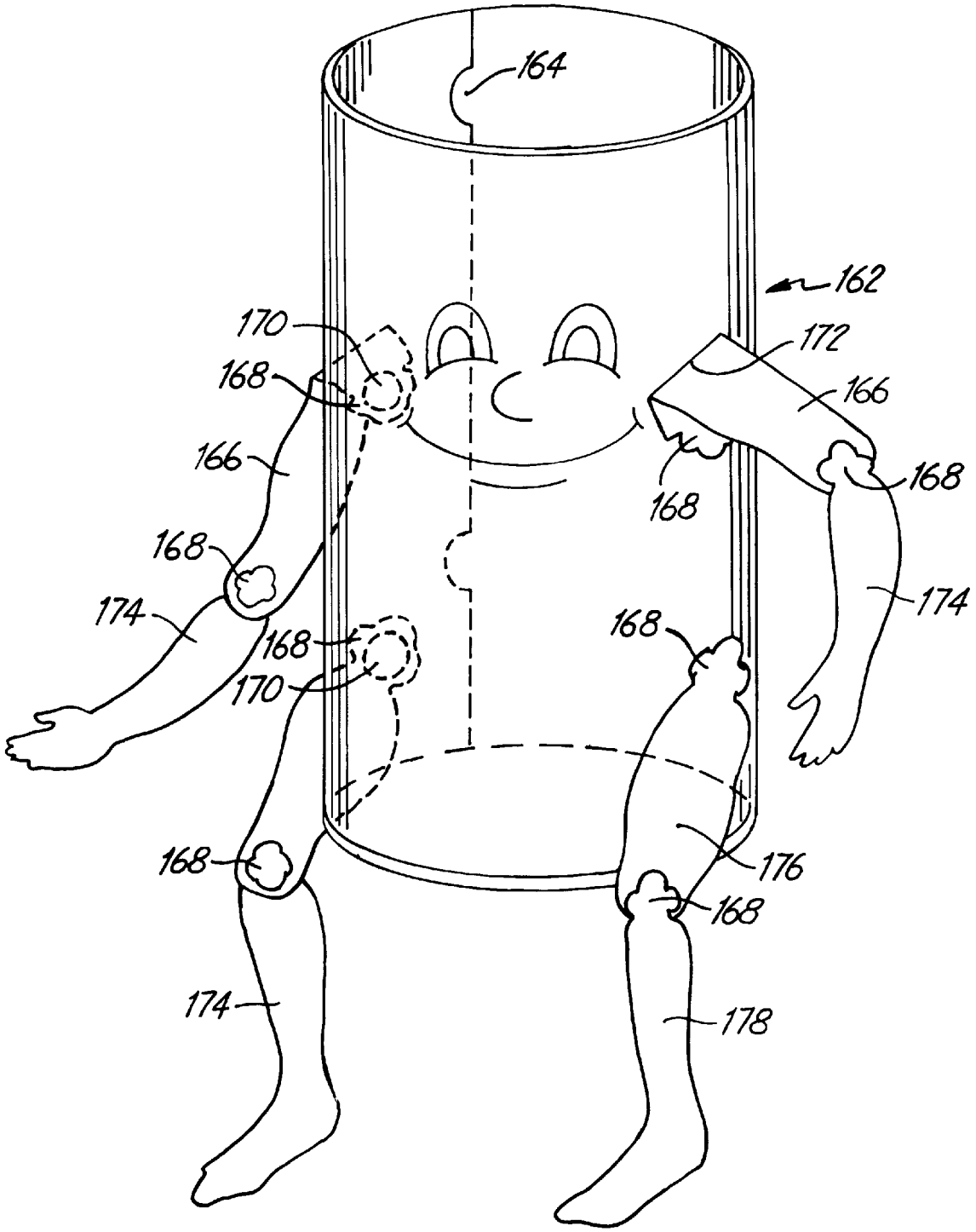
FIG. 21 is a perspective view of a character without a separate head.
Figure 22:
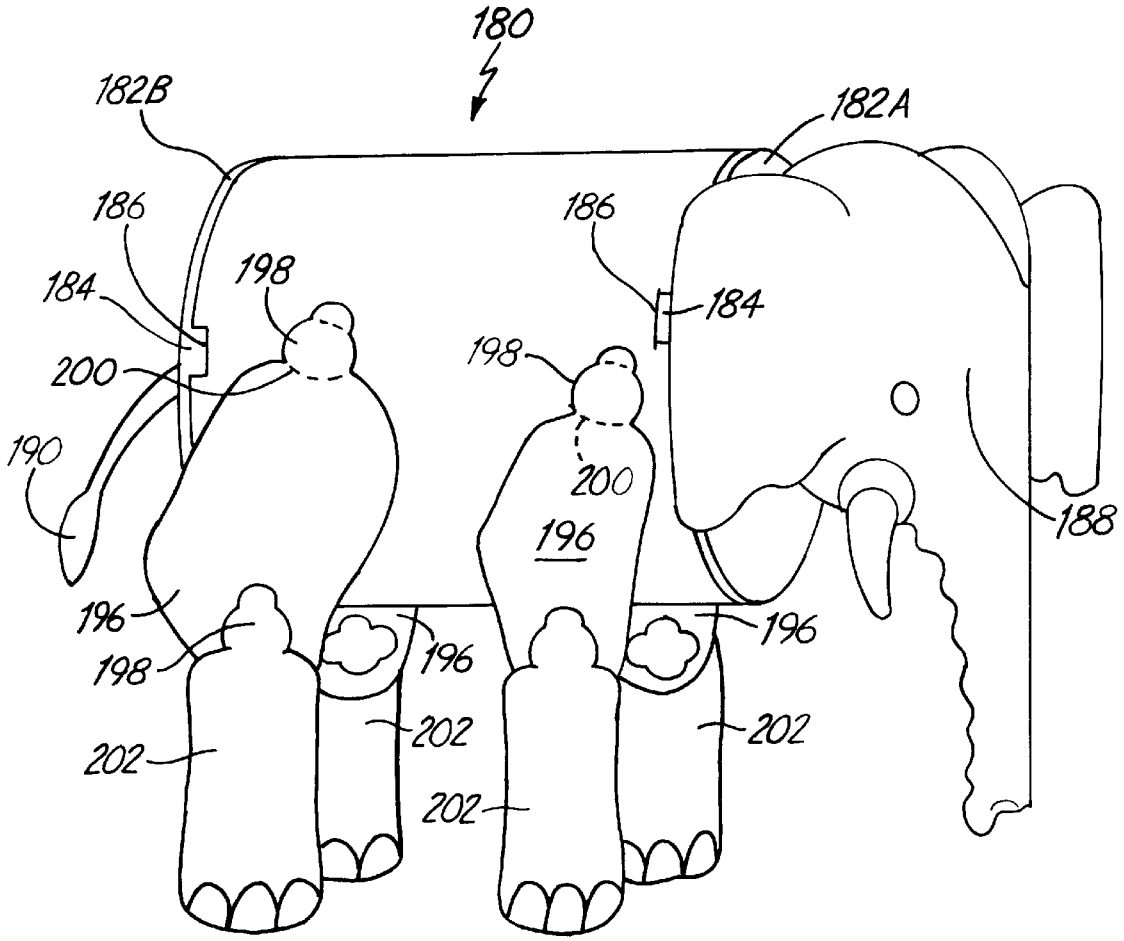
FIG. 22 is a perspective view of an elephant character with a separate head and tail.
Figure 23:
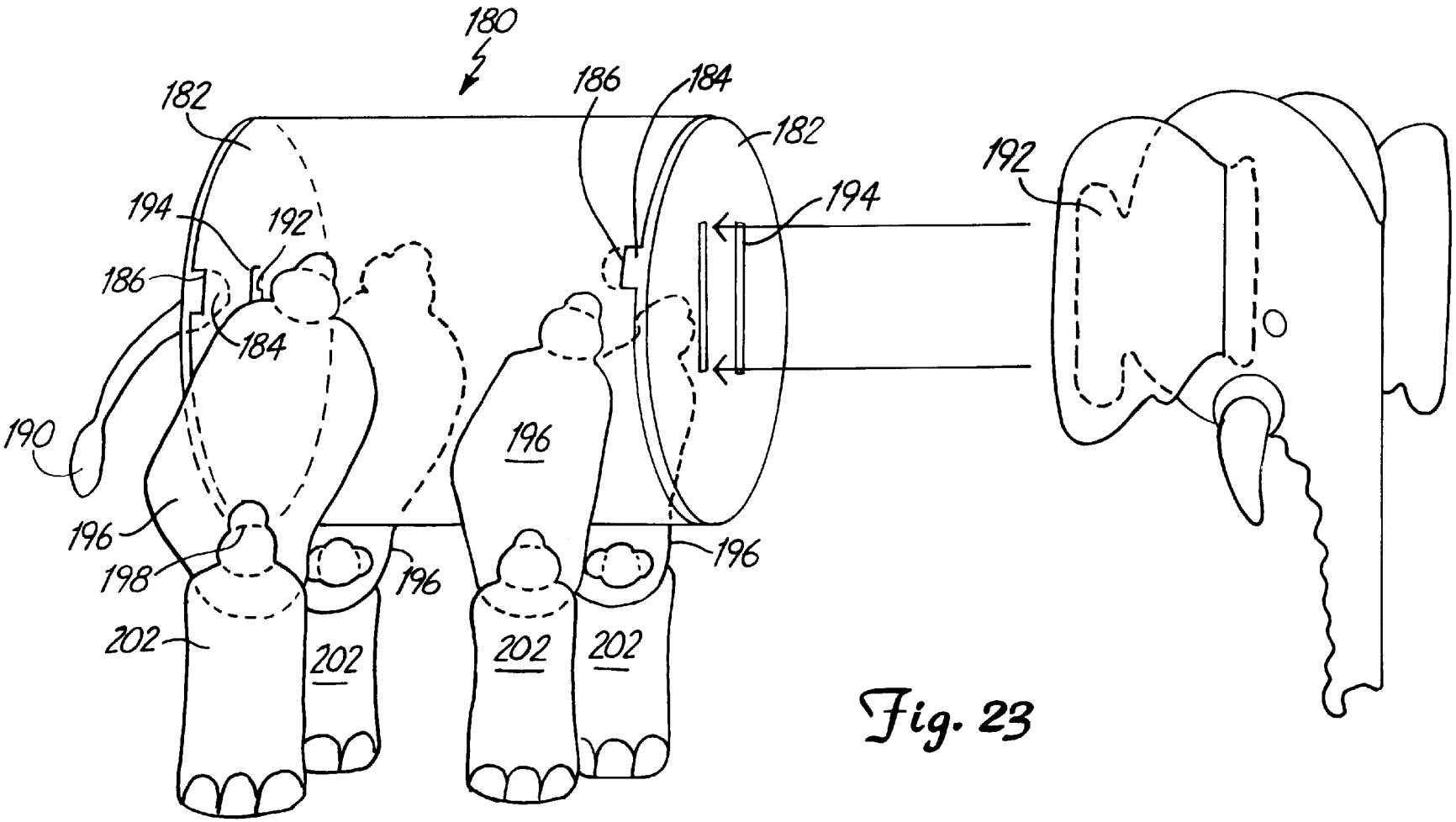
FIG. 23 is a perspective view showing the assembly of the elephant character of FIG. 22.

The characters of the present invention may take many different forms, and are limited only by the designer's imagination. Therefore, the specific characters described herein are to be considered examples, and should not be construed as limiting the scope of the invention. Several examples of the types of characters encompassed by the present invention are shown in the Figures. FIGS. 1–4 illustrate a dragon and elements of its construction. FIGS. 5–10 illustrate a human character. FIGS. 11 and 12 illustrate a dinosaur and a cartoon character, respectively, in an unassembled condition. FIGS. 13, 14 and 16–20 illustrate human characters and components of those characters. FIG. 15 illustrates a dog. FIG. 21 is a fanciful character, while FIG. 22 shows an elephant, and FIGS. 23 and 24 illustrate a cartoon character.

Figure 1:
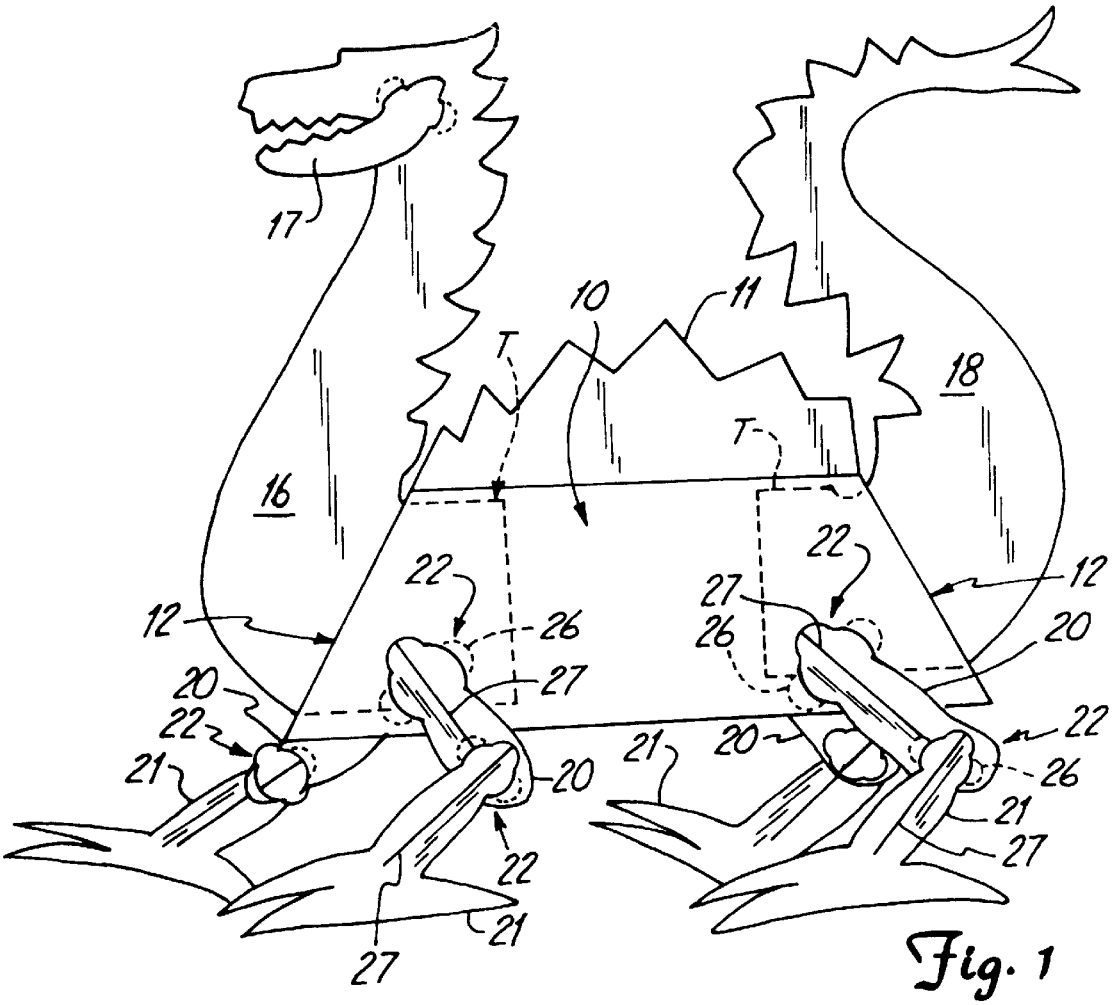
FIG. 1 is a side elevational view of a dragon character utilizing a folded carton torso and the joint of the present invention.
Figure 2:
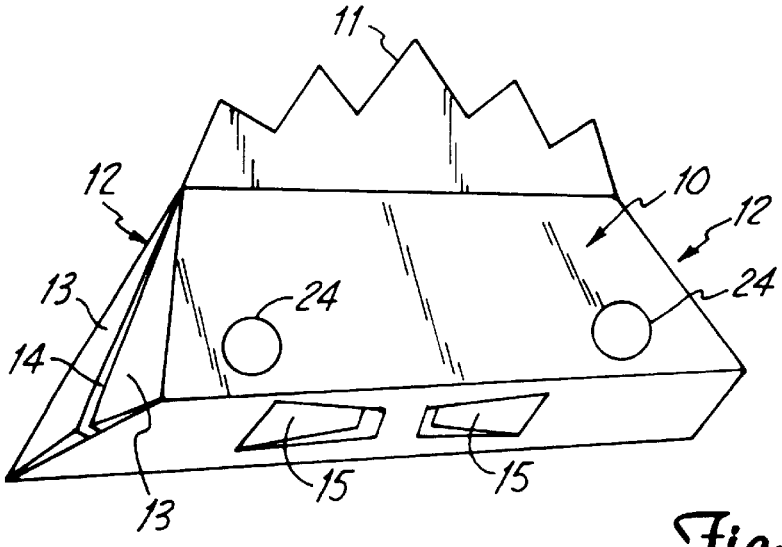
FIG. 2 is a perspective view of the folded carton torso member of the character of FIG. 1.

As an example of the construction utilized by the toy characters of the present invention, a dragon character is illustrated in FIGS. 1–4. As seen in FIG. 1, the dragon character possesses an elongated torso member 10 formed of a folded carton having a triangular cross-section to approximate an animal torso. The torso member 10 is best seen in FIG. 2. The folded carton torso member 10 includes a top surface 11 provided with a shape appropriate to the particular character to be represented (in this example, a dragon). The torso 10 includes end portions 12 having folded flaps 13 which form a slot 14 in end portion 12. Preferably, folded carton torso member 10 is designed to create one or more slots 14 to receive any members (such as head and neck 16 and tail 18) which are formed of sheet material and which are provided with a tab "T". Cut-outs 15 are provided such that the cutouts outs 15 may be bent into torso 10 to lend additional internal support to torso 10. To complete the character, the dragon further includes a head and neck 16, jaw 17, tail 18, upper legs 20, and lower legs 21. All members of the character are formed of a flat sheet material like the material used to form the torso 10.

Head and neck 16 and tail 18 are connected to torso 10 by sliding tab portions "T" into slots 14 formed in torso 10. As best seen in FIG. 2, the slots 14 in torso member 10 are formed between folded flaps 13 such that tab portions "T" of head and neck 16 and tail 18 are frictionally engaged in slots 14. Preferably, frictional engagement between tab "T" and slot 14 is sufficient to prevent unintended movement of the member, but also allows repositioning of the member if desired.

The dragon character includes several pivoting members. For example, upper legs 20 are pivotally connected to torso 10 by a joint 22. Similarly, lower legs 21 are pivotally connected to upper legs 20, and jaw 17 is pivotally connected to head and neck 16 by the joint 22.

Figure 3:
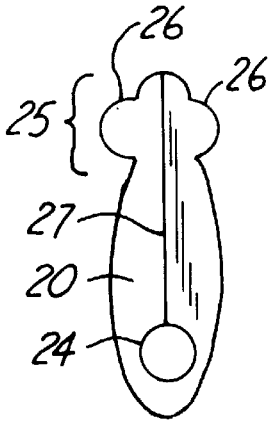
FIG. 3 is an elevational view of a movable member illustrating the head portion of the joint.

In considering the joint 22 used to pivotally secure the limbs and other members to the torsos of the characters, the major or stationary member is designated as the supporting member, while the dependent or extending member is considered the movable member. For example, in the joint of upper leg 20 with torso 10, the stationary member is torso 10, while the movable member is upper leg 20. However, the joint 22 does not have to be adjacent the torso member, as illustrated by the "knee" joint 22 between upper leg 20 (the stationary member in this case) and lower leg 21 (the movable member). Similarly, the novel joint 22 could be an elbow or a jaw or any other joint where pivotal movement is desired. The joint will be described herein by reference to the dragon character of FIGS. 1–4. However, the description applies to use of the joint 22 in a variety of characters. Several assembled joints 22 are seen in FIG. 1, while the individual components are best seen in FIGS. 2 and 3. Each joint 22 includes a circular opening 24 in the supporting member (in this instance torso 10) at the pivot point of the joint and a movable member (in this example, upper leg 20) with a head portion 25 designed to interlock with the circular opening 24 in the supporting member 10. The individual elements of the joint 22 are more easily seen in FIG. 2 (depicting hole 24 in the supporting member) and FIG. 3 (showing head portion 25 of the movable member).

As seen in FIG. 3, the head portion 25 of the movable member includes at least two tabs or ears 26 for engaging the opening 24 of the supporting member 10 and securing the movable leg member 20 to the supporting torso member 10. The tabs 26 are preferably diametrically opposed from each other. To assemble joint 22, the tabs 26 are bent and extended through the circular opening 24 such that they protrude beyond the diameter of the circular opening 24 and secure the movable leg member 20 to the supporting torso member 10.

Preferably, each movable member is further provided with a crease 27 extending longitudinally along the length of the movable member. The crease 27 provides the movable member with an additional three-dimensional effect by creating a more rounded, life-like movable member. The crease 27 also provides additional stability to the movable member by increasing the stiffness of the movable member. Because the movable member is formed from a flat, often flexible, sheet material, the movable member is more prone to bending or flexing if not supported in some manner. The provision of the longitudinal crease 27 reduces the movable member's ability to flex or bend, and thus provides additional strength and stability to the character. Finally, the crease 27 helps maintain the integrity of the joint 22 by creating a "spring" effect which forces the tabs 26 on the head 25 of the movable member firmly into contact with the circumference of the circular hole 24 in the supporting member. The friction between the supporting member and the movable member helps retain the movable member in a desired position, and prevents the movable member from moving freely in an unintended manner.

The joint 22 as described prevents inadvertent separation of the supporting member 10 and movable member 20 and allows the movable leg member 20 to rotate 360 degrees without disengaging from the supporting torso member 10. The joint 22 used to secure the movable members to the supporting member does not require any additional support, such as eyelets, rivets or the like. The joint 22 is therefore not only simple and mechanically efficient, but also allows a savings in material and the processing thereof, as a minimum amount of sheet material is required.

Typically, the unfolded torso and movable members may be cut from a single sheet of material, or multiple sheets of material if the size of the character so requires. Preferably, for ease of manufacture, only a single die-cut operation for cutting out the character and accompanying parts is required. As an example, the dragon character of FIG. 1 is shown in flat, uncut and unassembled form in FIG. 4. The various elements of the character are shown laid out on a sheet of material "M" as they would be laid out for a die-cutting operation. Preferably, the character would also be provided with pre-printed features such as eyes, hair, clothes, etc. which are appropriate to the particular character. The heavy weighted lines, labeled C, indicate where the material is to be cut, while the thinner lines labeled S, indicate score marks where the material is to be bent or folded. As an alternative to die-cutting the elements of the characters, the characters may be printed on the material to be cut out later by the user. For example, the unassembled and unfolded elements could be printed on a cereal box, and could be cut out after the contents of the box have been removed. The cut elements are then assembled as described below.

After cutting out the individual elements of the character, the folded carton torso 10 of the character would typically be assembled first. The torso 10 is folded along the lines "S" into a carton, and retains its three-dimensional shape by use of tabs, adhesive, tape, or other fastening means known in the art. The various movable members, such as upper legs 20 and lower legs 21 would then be attached to the proper stationary members by bending tabs 26 on the respective head portions 25 of the movable members and inserting the tabs 26 through the proper circular opening 24 provided in the stationary member. Other members, such as head and neck 16 or tail 18 are then inserted into slots 14 of torso 10 to complete construction of the character.

Figure 5:
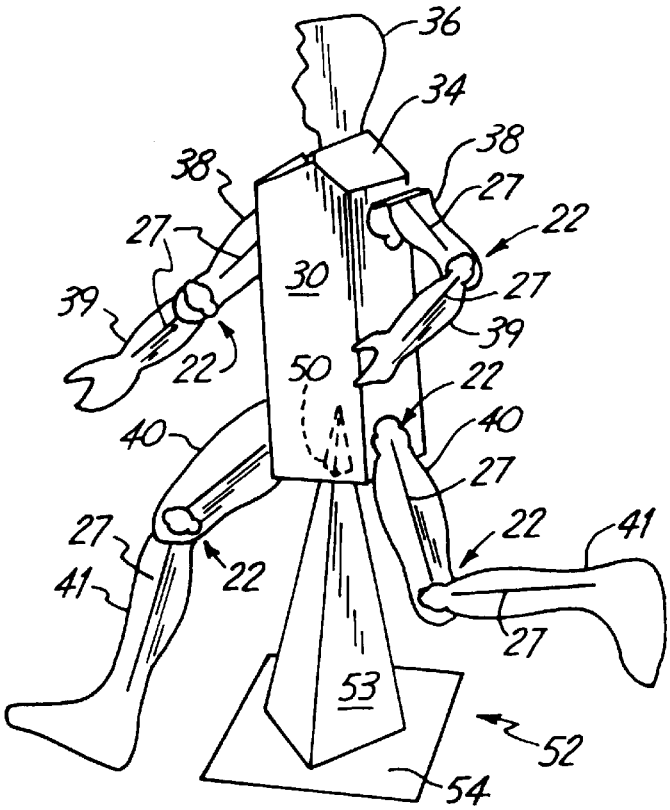
FIG. 5 is a perspective view of a human character utilizing a folded carton torso and the joint of the present invention.
Figure 6:
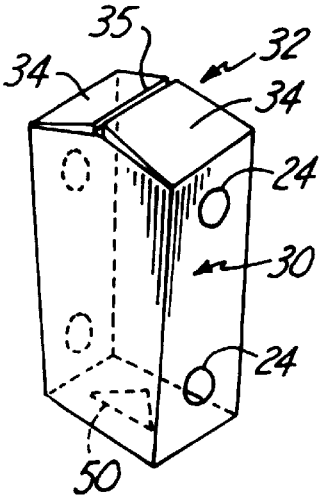
FIG. 6 is a perspective view of the folded carton torso member of the character of FIG. 5.
Figure 7:
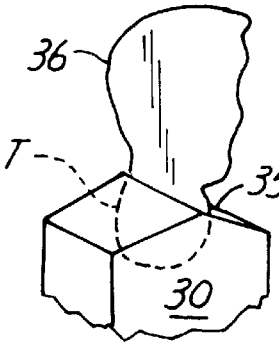
FIG. 7 is a perspective view of a head for a human character.
Figure 8A:
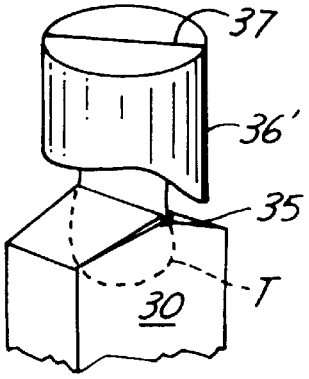
FIG. 8A is a perspective view of an alternative head for a human character.
Figure 4:
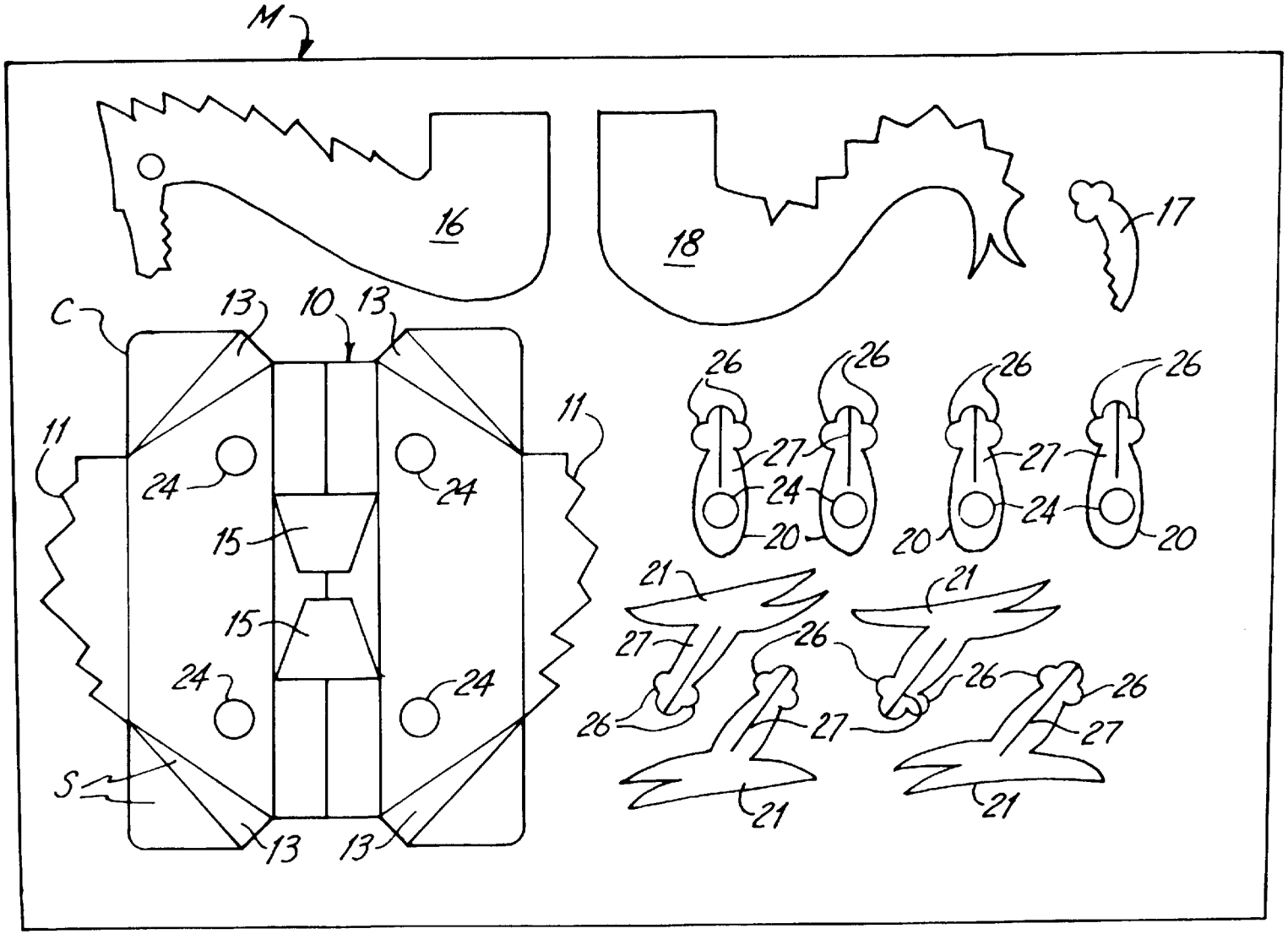
FIG. 4 is a plan view of unassembled and unfolded components of the dragon character of FIG. 1.
Figure 8B:
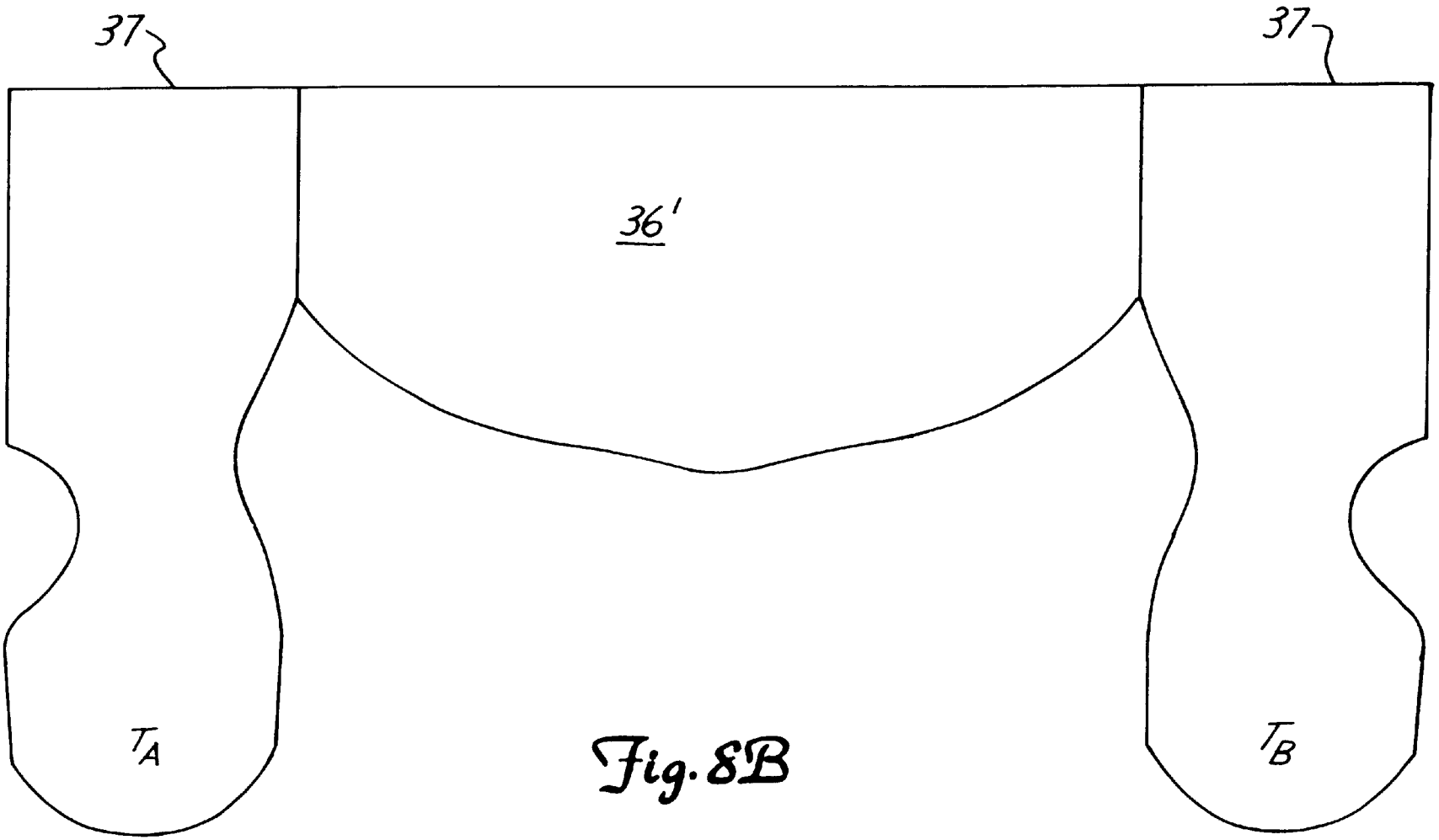
FIG. 8B is a plan view of an unfolded and unassembled three-dimensional head for a human character, as in FIG. 8A.

In contrast to the dragon character of FIGS. 1–4, a human character is illustrated in FIGS. 5–10. As best seen in FIGS. 5 and 6, the human character utilizes a folded carton torso member 30 having a generally rectangular shape, with a top portion 32 having sloped faces 34 to represent more life-like shoulders. Sloped faces 34 meet to form a slot 35, for attachment of a head 36. Head 36 is attached to torso 30 by sliding tab "T" of head 36 into slot 35, such that tab "T" also creates a neck for the human character (best seen in FIG. 7). Although FIG. 1 illustrates head 36 as having a flat appearance, other head and neck configurations are possible for human characters. For example, instead of forming head 36 as a flat piece of sheet material with an appropriate profile, the character's head may be provided with a three-dimensional appearance. As seen in FIG. 8A, a cylindrical head 36' (or other appropriate shape) with a flat tab "T" which can be slidably received by slot 35 may be used. FIG. 8B shows the cylindrical head 36' of FIG. 8A in an unfolded and unassembled configuration. The three-dimensional head 36' is created by rolling the flat sheet material into a cylinder and securing neck tab portions $T_A$ and $T_B$ to each other (with tape, adhesive, or the like) to form a supporting structure 37 within cylindrical head 36'.

The human character further includes upper arms 38, forearms 39, upper legs 40 and lower legs 41 which are formed from flat sheet material. Upper arms 38 and upper legs 40 are connected to the torso 30 by the novel joint 22 as described above for the dragon character, while forearms 39 and lower legs 41 are pivotally attached to upper arms 38 and upper legs 40, respectively.

Figure 9:
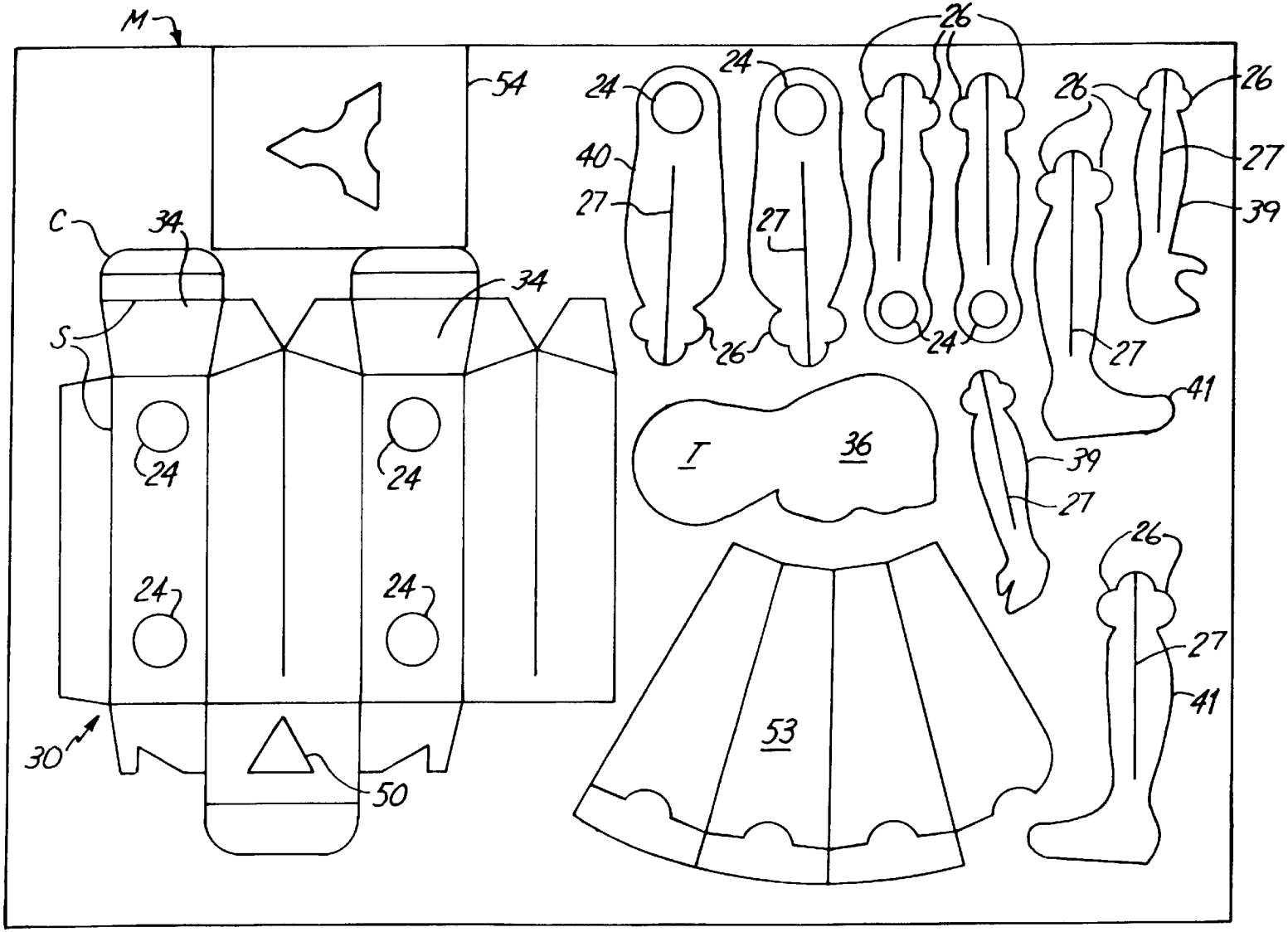
FIG. 9 is a plan view of unassembled and unfolded components of the human character of FIG. 5 having a rectangularly-shaped torso.

The elements of the human character of FIG. 5 are shown in FIG. 9 as they would be laid out on a sheet of material "M" for a die-cutting operation. As described above with reference to the dragon character, the toy is assembled by cutting out the various elements, assembling the folded carton torso 30, and attaching the various limbs to the torso 30.

It should be recognized that the folded carton torso 30 may take on a variety of shapes. The folded carton torso member 30 may be formed in any shape which approximates the torso of the character to be represented. For example, if a human torso having a rectangular cross-section is not desired, the torso member 30 of the human character could be formed with any number of cross-sectional shapes, such as a cylindrical shape. As an example, FIG. 10 shows an uncut and unassembled human character similar to that in FIG. 9, but having a cylindrical torso member 30' and shoulders 34'. Cylindrical torso 30' is assembled by rolling the sheet material into a cylinder and securing the carton with tabs 42, adhesive, or the like. Shoulders 34' are positioned adjacent an end of torso 30' and tabs 44 are secured to torso 30'. Shoulders 34' are provided with a slot 35' for receiving tab "T" of head 36.

Additional features may be added to the characters to increase their play value. As seen in FIGS. 5 and 6, the play value of the character may be increased by providing the torso member 30 of the human character with a triangular opening 50 opposite head 36. The opening 50 fits a mating stand 52 included with each character. When assembled, the stand 52 comprises a pyramidal mounting device 53 on a base 54 which interacts with the triangular opening 50 in the character's torso 30 to allow the character to rest on the stand 52 for display purposes while its limbs are posed in various manners as illustrated in FIG. 5. Although the triangular shape of opening 50 and mating stand 52 is preferred for ease of construction, alternatively shaped stands, such as rectangular or circular, are also possible and are considered within the scope of the present invention.

Finally, many other types of characters may be created using the folded carton torso and novel joint of the present application. As an example, FIG. 11 depicts an unassembled and unfolded dinosaur character, having a torso 62, head and neck 63, tail 64, and legs 65. The dinosaur character of FIG. 11 is similar in construction to the dragon character of FIGS. 1–4, and like elements are similarly numbered. Finally, FIG. 12 illustrates a cartoon character having torso and head 66, legs 67, and arms 68. The cartoon character of FIG. 12 includes an opening 50 for use with a support stand 52 (not shown) as described above in reference to the human character in FIGS. 5–10. The support stand 52 could be cut from a separate sheet of material, for example, or shared with another character in a set of multiple characters. The characters of FIGS. 11 and 12 are assembled as described for the dragon and human characters, and like elements carry similar reference numerals. As can clearly be seen, the folded carton torso and novel joint of the present application provide a wide variety of play characters, limited only by the designer's imagination.

Figure 13:
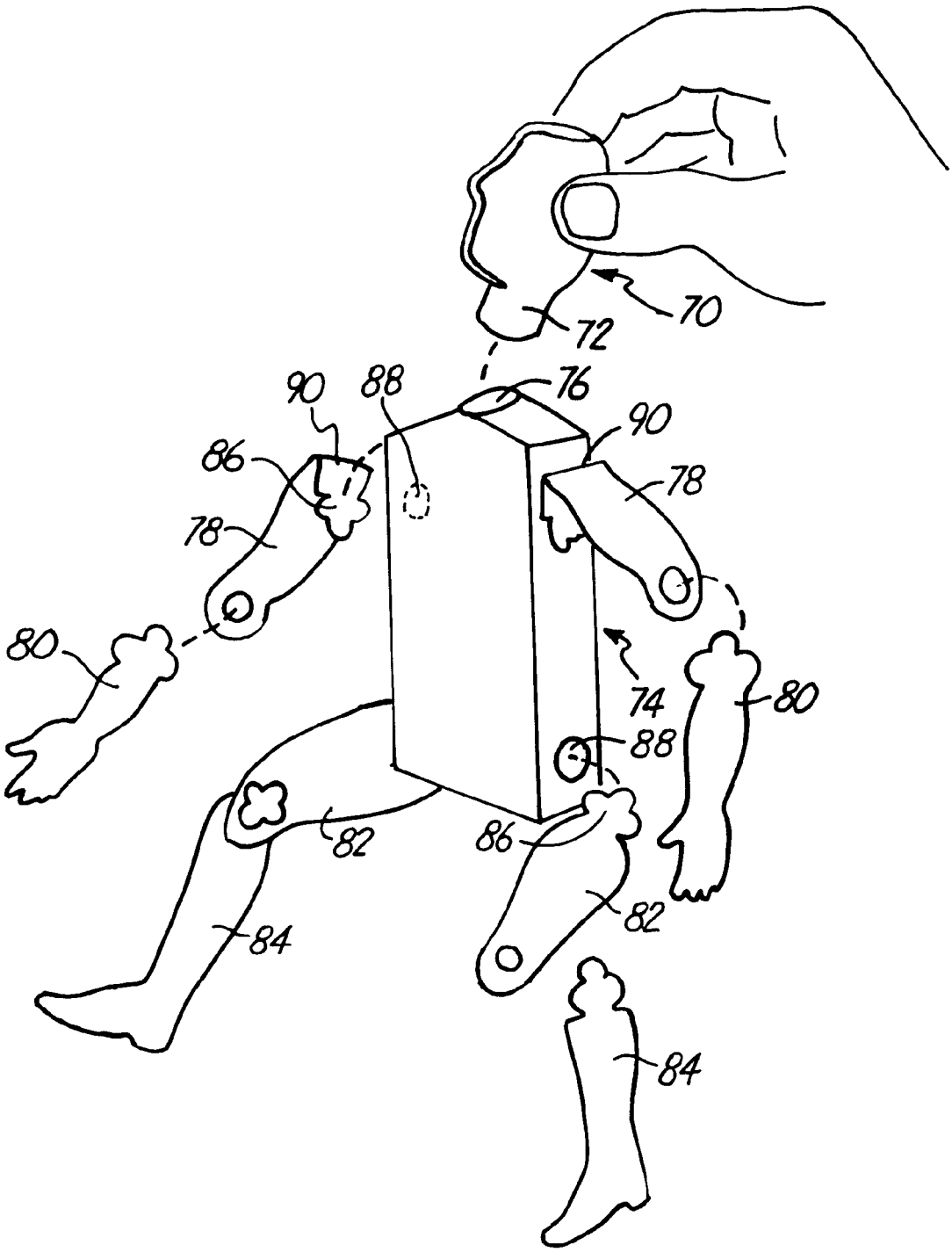
FIG. 13 is a perspective view of a human character with a rotatable head.

FIG. 13 illustrates a human character with a head 70 that has a cylindrical neck 72 which fits into circular torso hole 76. This invention allows the user to rotate the figure's head 360° , allowing for more variations and poses and therefore more possibilities in use. In addition to its ability to turn, the head also possesses a slight roundness which conveys a more realistic, 3-dimensional look. The character further includes upper arms 78, forearms 80, upper legs 82 and lower legs 84. Upper arms 78 are pivotally connected to the torso 74 by joint 86 through torso holes 88. The upper arms have a fold line at 90. This fold at the shoulder allows the arm to move up and down. Because joint 86 allows the arm to rotate, the combination of features 86 and 90 allows the figure's arms to move in a wide range of motion which imitates the movements of a human arm. Upper legs 82 are pivotally connected to torso 74 by joint 86 through torso holes 88. Forearms 80 and lower legs 84 are pivotally connected to upper arms 78 and upper legs 82, respectively.

Figure 14:
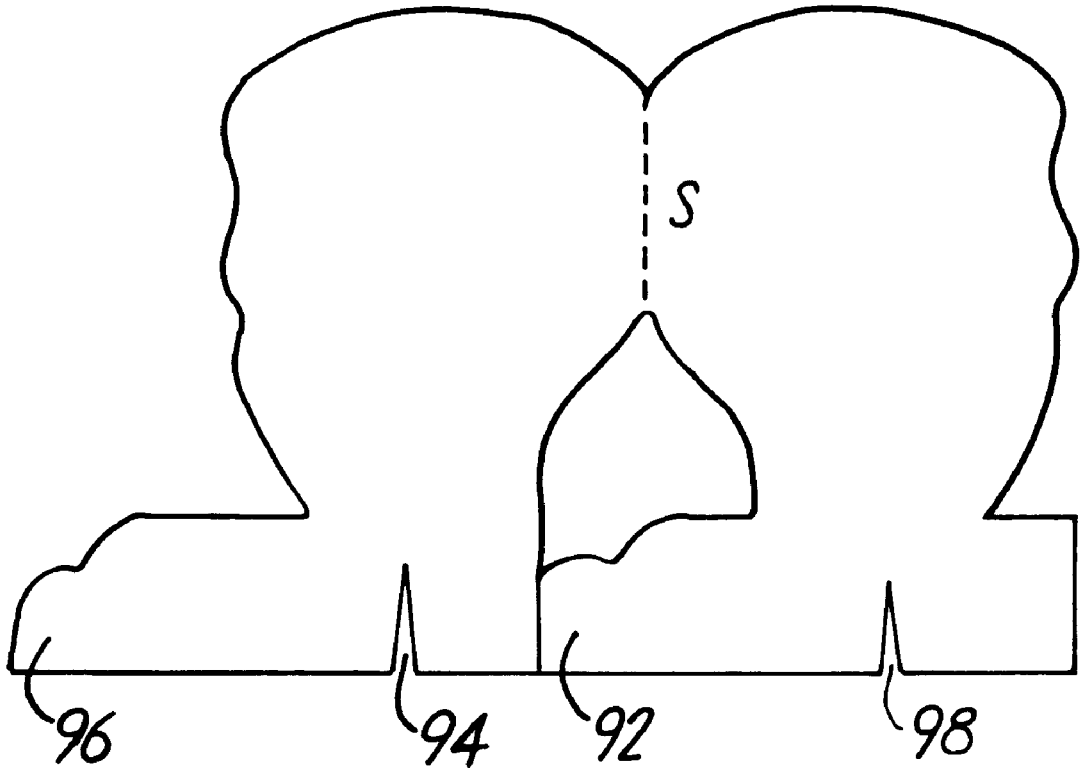
FIG. 14 is a plan view of an unassembled rotatable head.
Figure 15:
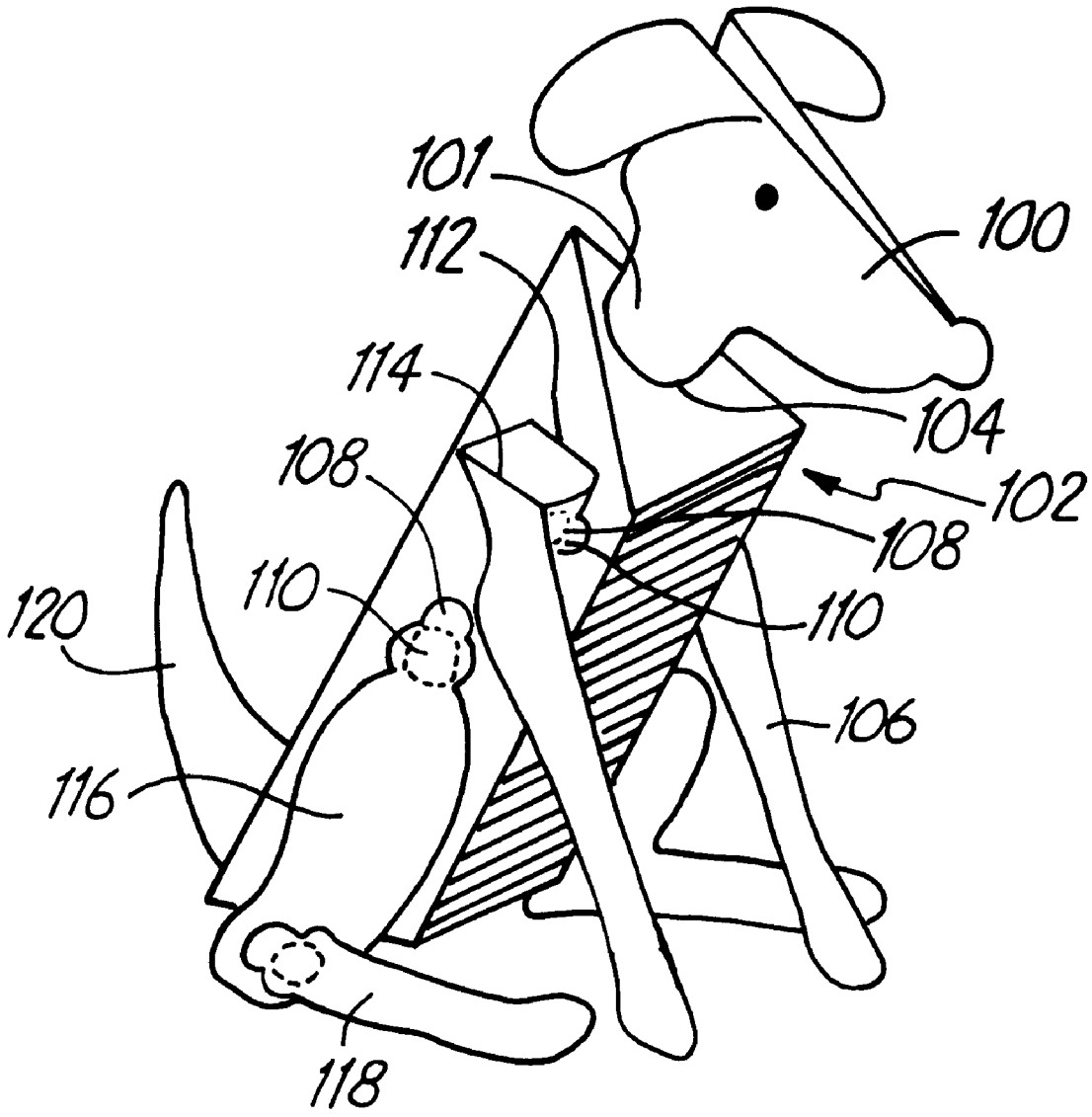
FIG. 15 is a perspective view of a dog character with a rotatable head.

FIG. 14 shows a plan view of an unassembled rotatable head. To construct the head, a user first cuts along the black lines. Then, the user folds the head along score line "S". Tab 92 is then inserted into notch 94. Tab 96 is then inserted into notch 98, following the direction of fold "S", to form a circular collar which serves both as a neck for the character and as a method of engagement into torso hole 76. The tabs may be secured in their corresponding notches with the use of tape, adhesive, staples, or any other method known in the art. FIG. 14 is an illustration of just one embodiment of a head with a cylindrical neck.

Many variations on the head are possible for other characters. For example, a dog is depicted in FIG. 15. The dog's head 100 has a cylindrical neck 101 which is inserted into torso 102 through circular torso hole 104. The dog's front legs 106 are pivotally connected to torso 102 by joint 108 through torso holes 110. The front legs have folds at lines 112 and 114 which allow the front legs to move in and out, as well as forward and backward. The extra width provided by the double fold also enhances the stability of the figure. Upper hind legs 116 are pivotally connected to torso 102 by novel joint 108 through torso holes 10. Lower hind legs 118 are pivotally connected to upper hind legs 116 by a similar pivotal joint. Tail 120 is also pivotally connected to torso 102. The use of joint 108 allows the tail to wag from left to right, thereby allowing realistic action and poses.

Figure 16:
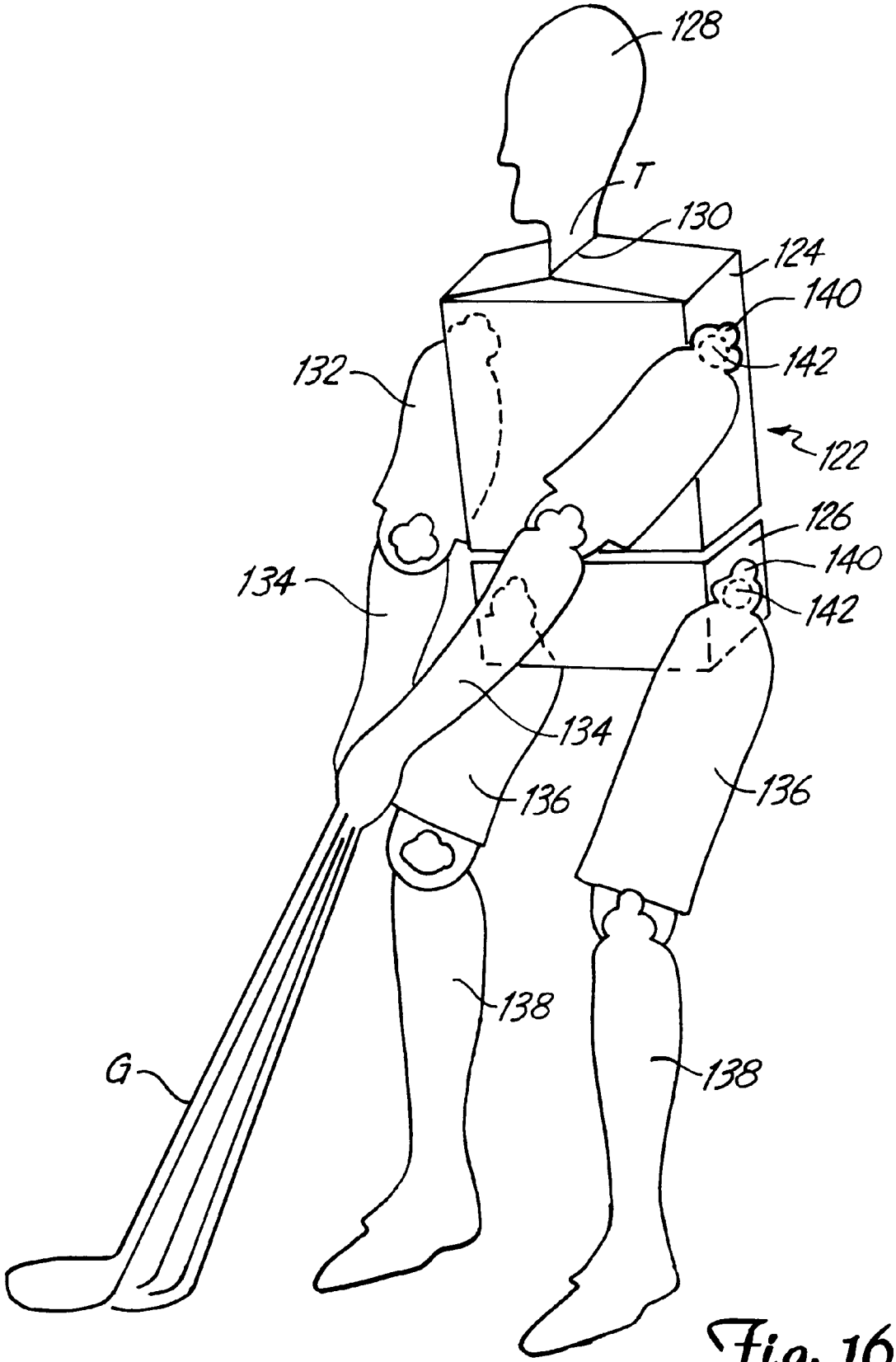
FIG. 16 is a perspective view of a human character with a two-section rotatable torso.

FIG. 16 illustrates a human figure with a torso 122 that comprises two or more sections which are rotatably connected so as to allow the character to be posed in more realistic stances by allowing the torso to twist.

Figure 17:
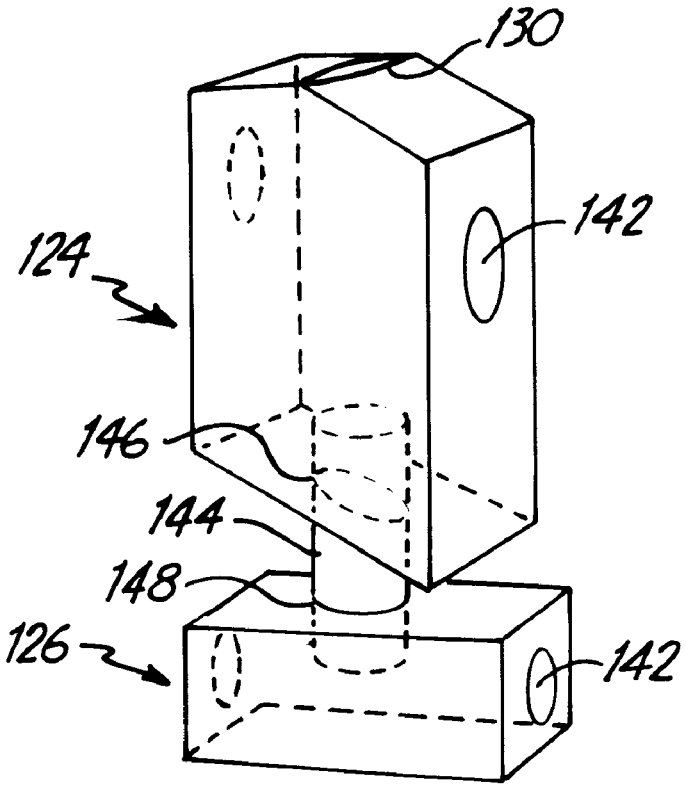
FIG. 17 is a perspective view of a two-section rotatable torso showing a cylindrical connector between the torso sections.
Figure 18:
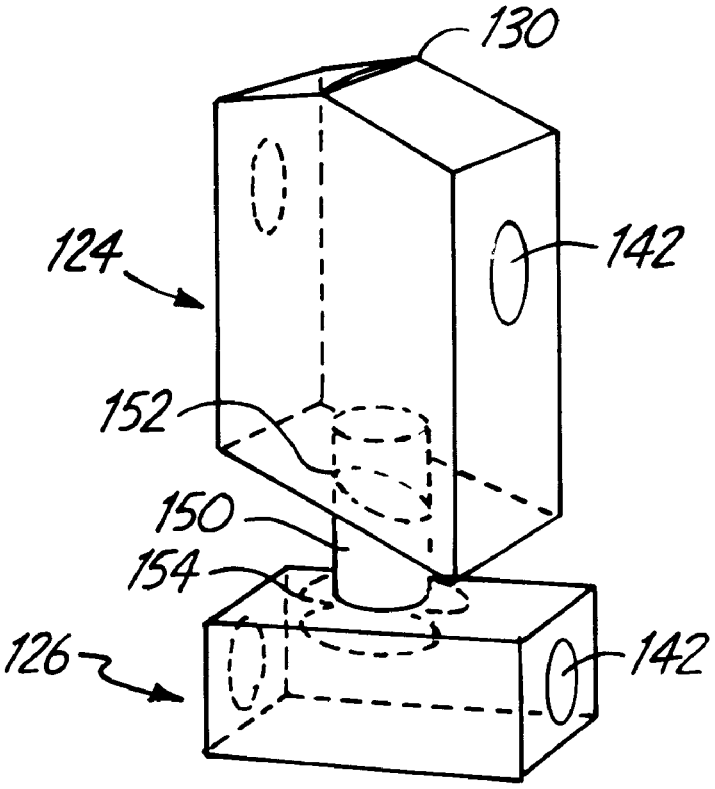
FIG. 18 is a perspective view of a two-section rotatable torso showing an alternative connector.

The upper torso section 124 and lower torso section 126 are connected by a cylindrical connector, as illustrated in FIGS. 17 and 18. The human figure also includes a head 128 which is attached to the torso by sliding tab "T" into slot 130 of upper torso section 124. Alternatively, a head with a cylindrical neck (as illustrated in FIGS. 13–15) can be used. The human character further includes upper arms 132, forearms 134, upper legs 136 and lower legs 138 which are formed from sheet material. Upper arms 132 and upper legs 136 are pivotally connected to torso sections 124 and 126 by joints 140 through torso holes 142. Forearms 134 and lower legs 138 are pivotally connected to upper arms 132 and upper legs 136, respectively. A golf club G is shown extending from forearms 134.

FIG. 17 shows a torso comprised of two sections: upper section 124 and lower section 126, which are connected by a cylindrical member 144 through circular holes 146 and 148. The cylindrical member may be made of any material; for example, cylindrical member 144 may be any cylindrical object, i.e., a straw, a dowel or a peg. FIG. 17 also shows slot 130 and holes 142, through which the head, arms, and legs of the figure are attached.

FIG. 18 shows a torso comprised of two sections which are connected by cylindrical member 150 through torso holes 152 and 154. Cylindrical member 150 may be formed from the same sheet material used for the character, or any other flexible sheet material. Like FIG. 17, FIG. 18 also shows slot 130 and holes 142, through which the head, arms, and legs of the figure are attached.

Figure 19:
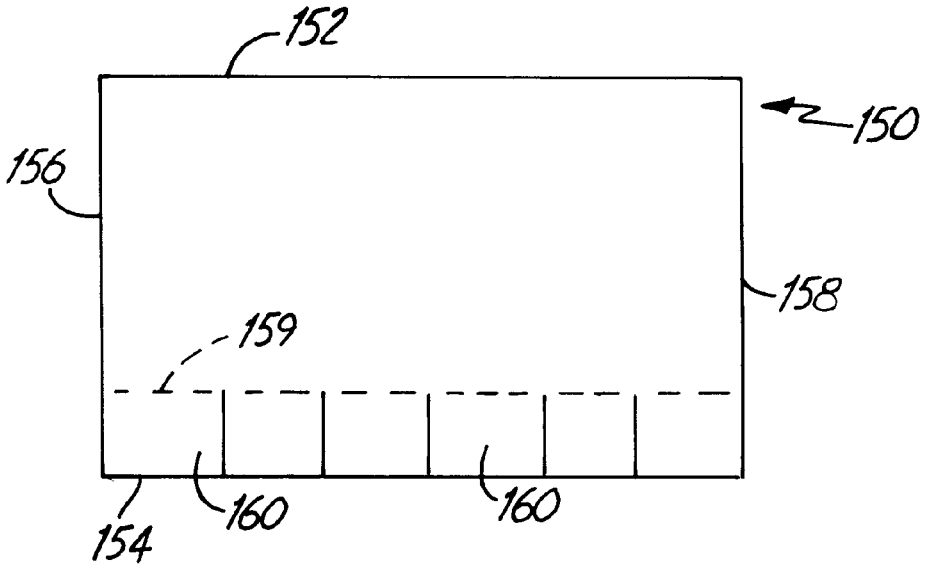
FIG. 19 is a plan view of the unassembled connector of FIG. 18.

FIG. 19 illustrates an unassembled plan view of cylindrical member 150, which is a rectangular sheet having top and bottom edges 152 and 154 and side edges 156 and 158. A series of slits extend upward from bottom edge 154 to fold line 159 to form flanges 160.

Figure 20:
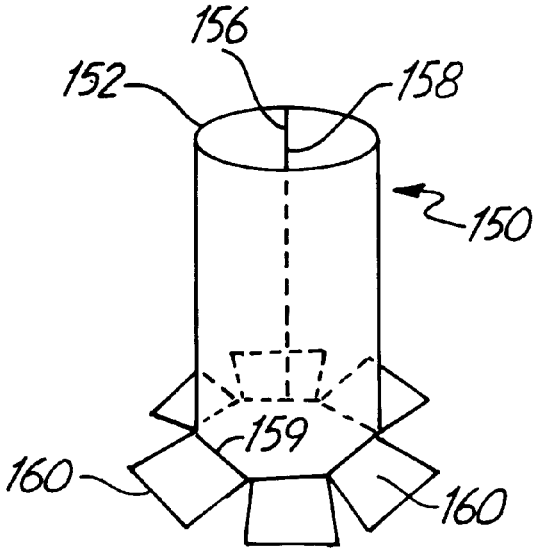
FIG. 20 is a perspective view of the assembled connector of FIG. 18.

FIG. 20 shows an assembled cylindrical member 150 which is formed by rolling the sheet material to align and attach edges 156 and 158 and then folding out flanges 160. Edges 156 and 158 can be secured by tape, adhesive, tabs and slots, or other attachment means. The flanges serve to prevent the cylindrical member from disengaging from lower torso section 126. These flanges can also be used on the upper portion of cylindrical member 150 to prevent it from disengaging from upper section 124 of the torso. An advantage of making member 150 of the same material as the rest of the character is that no additional supplies are needed particularly for the connector.

The character may or may not have a separate head or tail as shown in FIGS. 21 through 24. FIG. 21 illustrates one preferred embodiment of the invention. This particular character's torso 162 is cylindrically shaped; however, the torso may be of any shape appropriate for the character desired. Torso 162 may be constructed of flexible sheet material. FIG. 21 shows a character in which a piece of material is rolled and then attached to itself at 164 to form a cylinder. The attachment at 164 may be performed by any means known in the art, such as with the use of tabs, adhesive, staples or other fasteners. A face is formed on a front surface of torso 162. The character has upper arms 166 which are pivotally connected to torso 162 by joint 168 through torso holes 170. Upper arm 166 has a shoulder fold at 172 which allows the arm to move in an up and down motion, as well as a rotating motion. Lower arms 174 are pivotally connected to upper arms 166 by joint 168. The character also has upper legs 176 which are pivotally connected to torso 162 by novel joint 168 through torso holes 170. Lower legs 178 are pivotally connected to upper legs 176 by joint 168. The torso may be open at both ends, as in FIG. 21.

Alternatively, the torso may be closed at the ends, as shown in FIGS. 22 and 23. For example, in the elephant of FIGS. 22 and 23, an open cylinder 180 is capped at both ends with circular pieces 182A and 182B. Tabs 184 of circular pieces 182A and 182B may be inserted into slots 186 of torso 180 to secure circular pieces 182A and 182B to torso 180. Then, members such as a head 188 or tail 190 may be attached to circular pieces 182A or 182B by inserting tabs 192 of head 188 or tail 190 into slots 194 of circular pieces 182. Upper leg members 196 are pivotally connected to torso 180 by joint 198 through torso holes 200. Lower legs 202 are pivotally connected to upper legs 196 by the joint 198.

Figure 24A:
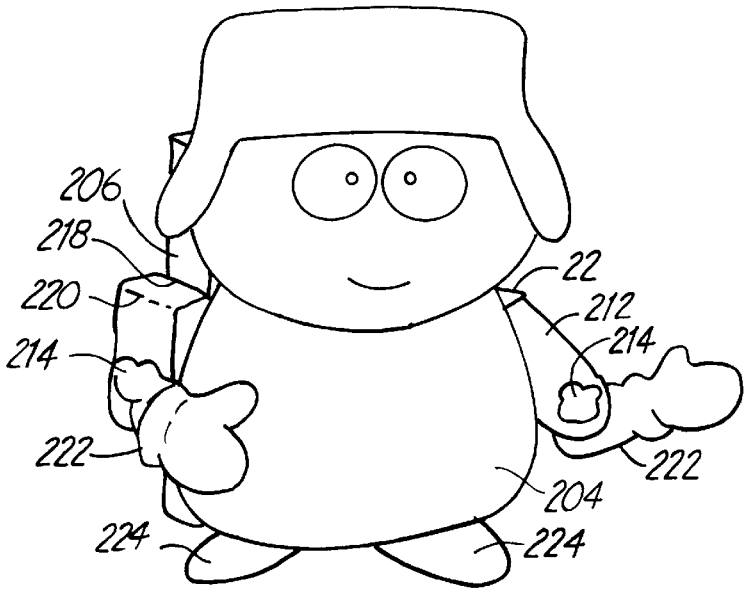
FIGS. 24A–24C are perspective views of a cartoon character, showing a printed facade attached to a pre-formed carton torso.
Figure 24B:
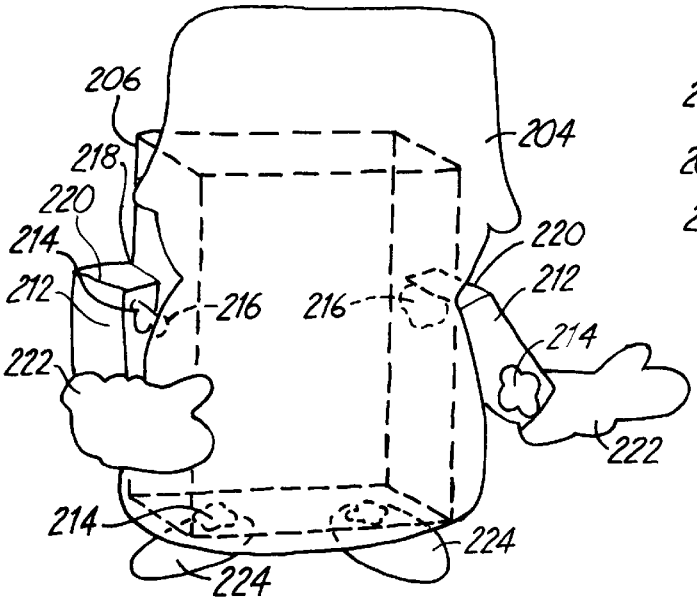
Figure 24C:
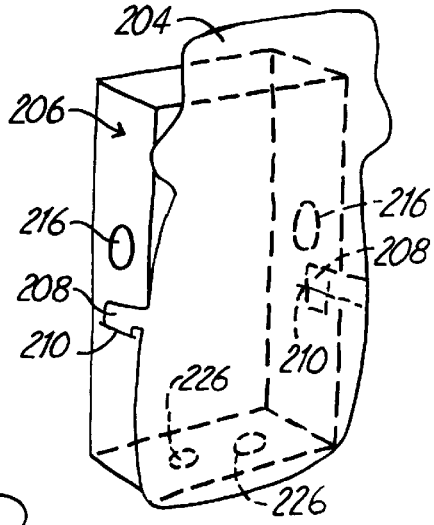

FIGS. 24A–24C show a character in which a printed facade 204 is attached to a box or carton torso 206. FIG. 24A is a perspective view of the assembled character. FIG. 24B is similar to FIG. 24A but shows portions in phantom. FIG. 24C shows a partial assembly of box 206 and facade 204.

Facade 204 is attached to box 206 by the insertion of tabs 208 into slots 210, as best shown in FIG. 24C. Upper arms 212 are pivotally connected to box 206 by joint 214 through box holes 216. The upper arms have shoulder folds at 218 and 220. These folds allow the arms to move up and down, as well as to rotate forward and backward. The extra fold at 220 allows the arm to stand out from the box in order to accommodate a facade which is wider than the box. Lower arms 222 are pivotally connected to upper arms 212 by joint 214. Feet 224 are pivotally connected to box 206 by joint 214 through box holes 226. This pivotal connection allows feet 224 to swivel underneath the character's body to allow for variations in posing and motion.

Although the present invention has been described with reference to preferred embodiments, workers skilled in the art will recognize that changes may be made in form and detail without departing from the spirit and scope of the invention.

What is claimed is:

1. A posable toy character capable of assuming a multiplicity of different poses, the posable toy character comprising:

a three dimensional carton body formed of pliable sheet material, the body comprising a front surface, a left side surface, and a right side surface;

a head formed of pliable sheet material and connected to the body;

a left leg formed of pliable sheet material and pivotally connected to the left side surface by a frictional joint which permits the left leg to be moved to and remain in a multiplicity of different poses, where the joint allows the leg to pivot 360 degrees without disengagement from the body;

a right leg formed of pliable sheet material and pivotally connected to the right side surface by a frictional joint which permits the right leg to be moved to and remain in a multiplicity of different positions, where the joint allows the leg to pivot 360 degrees without disengagement from the body;

a left arm formed of pliable sheet material and pivotally connected to the left side surface by a frictional joint which permits the left arm to be moved to and remain in a multiplicity of different positions, where the joint allows the arm to pivot 360 degrees without disengagement from the body; and a right arm formed of pliable sheet material and pivotally connected to the right side surface by a frictional joint which permits the right arm to be moved to and remain in a multiplicity of different positions, where the joint allows the arm to pivot 360 degrees without disengagement from the body.

2. A posable toy character capable of assuming a multiplicity of different poses, the posable toy character comprising:

a three dimensional carton torso, the torso having a front surface, a left side surface, and a right side surface;

wherein the torso comprises:

an upper torso to which the left and right arms are pivotally connected;

a lower torso to which the left and right legs are pivotally connected; and a pivotable connection between the upper torso and the lower torso;

a head connected to the torso;

a left leg pivotally connected to the left side surface by a frictional joint which permits the left leg to be moved to and remain in a multiplicity of different poses;

a right leg pivotally connected to the right side surface by a frictional joint which permits the right leg to be moved to and remain in a multiplicity of different positions;

a left arm pivotally connected to the left side surface by a frictional joint which permits the left arm to be moved to and remain in a multiplicity of different positions; and right arm pivotally connected to the right side surface by a frictional joint which permits the right arm to be moved to and remain in a multiplicity of different positions.

3. The posable toy character of claim 2 wherein the upper torso has a circular opening in a lower surface and the lower torso has a circular opening in an upper surface, and the pivotable connection includes a cylindrical member which extends through the circular openings to connect the upper and lower torsos.

4. A posable toy character capable of assuming a multiplicity of different poses, the posable toy character comprising:

a head formed of pliable sheet material;

a three dimensional carton torso formed of pliable sheet material, the torso comprising a front surface, a left side surface, and a right side surface;

wherein the torso further comprises a top surface with a circular neck opening, and wherein the head includes a cylindrical neck portion which extends into the circular neck opening to connect the head to the torso;

a left leg formed of pliable sheet material and pivotally connected to the left side surface by a frictional joint which permits the left leg to be moved to and remain in a multiplicity of different poses;

right leg formed of pliable sheet material and pivotally connected to the right side surface by a frictional joint which permits the right leg to be moved to and remain in a multiplicity of different positions;

a left arm formed of pliable sheet material and pivotally connected to the left side surface by a frictional joint which permits the left arm to be moved to and remain in a multiplicity of different positions; and a right arm formed of pliable sheet material and pivotally connected to the right side surface by a frictional joint which permits the right arm to be moved to and remain in a multiplicity of different positions.

5. The posable toy character capable of assuming a multiplicity of different poses the posable toy character comprising:

a three dimensional carton body, the body comprising a front surface, a left side surface, and a right side surface, wherein the body is generally cylindrical with a generally circular cross section;

a head connected to the body;

a left leg pivotally connected to the left side surface by a frictional joint which permits the left leg to be moved to and remain in a multiplicity of different poses, where the joint allows the leg to pivot 360 degrees without disengagement from the body, a right leg pivotally connected to the right side surface by a frictional joint which permits the right leg to be moved to and remain in a multiplicity of different positions, where the joint allows the leg to pivot 360 degrees without disengagement from the body, a left arm pivotally connected to the left side surface by a frictional joint which permits the left arm to be moved to and remain in a multiplicity of different positions, where the joint allows the arm to pivot 360 degrees without disengagement from the body; and a right arm pivotally connected to the right side surface by a frictional joint which permits the right arm to be moved to and remain in a multiplicity of different positions, where the joint allows the arm to pivot 360 degrees without disengagement from the body.

6. A posable toy character capable of assuming a multiplicity of different poses, the posable toy character comprising:

a three dimensional folded carton body;

first and second left limbs projecting from the body; and first and second right limbs projecting from the body;

wherein each of the limbs has a proximal end pivotally connected to and in frictional engagement with the body so that each limb can be pivotally moved to a multiplicity of different positions with respect to the body and will remain in a position to which it is moved by frictional engagement of its proximal end with the body, where a pivotal connection allows each limb to pivot 360 degrees without disengagement from the body.

7. The posable toy character of claim 6 wherein the body is generally cylindrical with a generally circular cross section.

8. The posable toy character of claim 6 and further comprising:

a character facade formed of sheet material and attached to the body and positioned in front of the body.

9. The possible toy character of claim 8 wherein the facade has tabs which are inserted into slots in the body to attach the facade to the body.

10. A posable toy character capable of assuming a multiplicity of different poses, the posable toy character comprising:

a three dimensional folded carton torso, wherein the torso comprises:

an upper torso to which the first left limb and the first right limb are pivotally connected;

lower torso to which the second left limb and second right limb are pivotally connected; and a pivotable connection between the upper torso and the lower torso;

first and second left limbs projecting from the torso; and first and second right limbs projecting from torso;

wherein each of the limbs has a proximal end pivotally connected to and in frictional engagement with the torso so that each limb can be pivotally moved to a multiplicity of different positions with respect to the torso and will remain in a position to which it is moved by frictional engagement of its proximal end with the torso.

11. The posable toy character of claim 10 wherein the upper torso has a circular opening in a lower surface and the lower torso has a circular opening in an upper surface, and the pivotable connection includes a cylindrical member which extends through the circular openings to connect the upper and lower torsos.

12. The posable toy character of claim 11 and further comprising:

a character facade formed of sheet material and attached to the torso and positioned in front of the torso.

13. The posable toy character of claim 12 wherein the facade has tabs which are inserted into slots in the torso to attach the facade to the torso.

14. A posable toy character capable of assuming a multiplicity of different poses, the posable toy character comprising:

a three dimensional folded carton torso;

wherein the torso has a top surface with a circular neck opening, and wherein a head is pivotally mounted to the torso by a cylindrical neck portion which extends into the circular neck opening;

first and second left limbs projecting from the torso; and first and second right limbs projecting from the torso;

wherein each of the limbs has a proximal end pivotally connected to and in frictional engagement with the torso so that each limb can be pivotally moved to a multiplicity of different positions with respect to the torso and will remain in a position to which it is moved by frictional engagement of its proximal end with the torso.

15. A posable toy character comprising:

a cylindrical body formed of sheet material, the body having a first pair of holes spaced apart near a first end of the body and a second pair of holes spaced apart near a second end of the body;

a first pair of limbs formed of sheet material, each of the limbs including a proximal end pivotally connected to one of the first pair of holes and in frictional engagement with the body so that each of the first pair of limbs can be pivotally moved to a multiplicity of different positions with respect to the body and will remain in the position to which it is moved by frictional engagement of its proximal end with the body, where a pivotal connection allows each limb to pivot 360 degrees without disengagement from the body; and a second pair of limbs formed of sheet material, each of the limbs including a proximal end pivotally connected to one of the second pair of holes and in frictional engagement with the body so that each of the second pair of limbs can be pivotally moved to a multiplicity of different positions with respect to the body and will remain in the position to which it is moved by frictional engagement of its proximal end with the body, where a pivotal connection allows each limb to pivot 360 degrees without disengagement from the body.

16. The posable toy character of claim 5 and further comprising:

a first end piece mounted to a first end of the body; and a head attached to the first end piece.

17. The posable toy character of claim 16 and further comprising:

a second end piece mounted to a second end of the body; and a tail attached to the second end piece.

18. A posable toy character capable of assuming a multiplicity of different poses, the posable toy character comprising:

a three dimensional folded carton body; and first and second limbs projecting from body;

wherein each of the limbs has a proximal end pivotally connected to and in frictional engagement with the body so that each limb can be pivotally moved to a multiplicity of different positions with respect to the body and will remain in a position to which it is moved by frictional engagement of its proximal end with the body, where the pivotal connection allows each limb to pivot 360 degrees without disengagement from the body.

19. The posable toy character of claim 18 wherein the body comprises:

an upper body;

a lower body; and a pivotable connection between the upper body and the lower body.

20. The posable toy character of claim 19 wherein the upper body has a circular opening in a lower surface and the lower body has a circular opening in an upper surface, and the pivotable connection includes a cylindrical member which extends through the circular openings to connect the upper and lower bodies.

21. The posable toy character of claim 18 wherein the body has a top surface with a circular neck opening, and wherein a head is pivotally mounted to the body by a cylindrical neck portion which extends into the circular neck opening.

22. The posable toy character of claim 18 wherein the body is generally cylindrical with a generally circular cross section.

23. The posable toy character of claim 18 and further comprising:

a character facade formed of sheet material and attached to the body and positioned in front of the body.

24. The posable toy character of claim 23 wherein the facade has tabs which are inserted into slots in the body to attach the facade to the body.

25. A toy character with a three dimensional carton body, wherein the body comprises:

a three dimensional carton upper body formed of pliable sheet material;

a three dimensional carton lower body formed of pliable sheet material; and a pivotable connection between the upper body and lower body.

26. A toy character with a three dimensional carton body, wherein the body comprises:

a three dimensional carton upper body, wherein the upper body has a circular opening in a lower surface;

a three dimensional carton lower body, wherein the lower body has a circular opening in an upper surface; and a pivotable connection between the upper body and lower body, wherein the pivotable connection includes a cylindrical member which extends through the circular openings to connect the upper and lower bodies.

27. A toy character formed of pliable sheet material with a three dimensional carton body and a head connected to the body, wherein the body has a top surface with a circular neck opening, and wherein the head includes a cylindrical neck portion which extends into the circular neck opening to connect the head to the body.

28. A toy character comprising:

a three dimensional folded carton body formed of pliable sheet material;

a character facade formed of sheet material and attached to the body and positioned in front of the body; and a plurality of appendages, each appendage pivotally connected to the body by a frictional joint which permits each appendage to be moved to and remain in a multiplicity of different poses, where the joint allows the appendage to pivot 360 degrees without disengagement from the body.

29. The toy character of claim 28 wherein the facade has tabs which are inserted into slots in the body to attach the facade to the body.

* * * * *

UNITED STATES PATENT AND TRADEMARK OFFICE

CERTIFICATE OF CORRECTION

PATENT NO. : 6,120,344
DATED : September 19, 2000
INVENTOR(S) : Jerry L. Brown

It is certified that error appears in the above-identified patent and that said Letters Patent is hereby corrected as shown below:

Column 11,
Line 19, before "right", insert -- a --

Column 12,
Line 27, before "lower", insert -- a --

Signed and Sealed this

First Day of January, 2002

*Attest:*

*Attesting Officer*

JAMES E. ROGAN
*Director of the United States Patent and Trademark Office*